US005916023A

United States Patent [19]

Meyer

[11] Patent Number: 5,916,023

[45] Date of Patent: Jun. 29, 1999

[54] HOODED EXHAUST VENT

[75] Inventor: Stephen T. Meyer, Indianapolis, Ind.

[73] Assignee: Deflecto Corporation, Indianapolis, Ind.

[21] Appl. No.: 08/897,065

[22] Filed: Jul. 18, 1997

[51] Int. Cl.[6] ..... F23L 17/02

[52] U.S. Cl. ..... 454/359; 34/235; 454/367

[58] Field of Search ..... 34/235; 454/30, 454/31, 212, 227, 353, 359, 215, 367

[56] References Cited

U.S. PATENT DOCUMENTS

| | | | |
|---|---|---|---|
| 2,247,947 | 7/1941 | Henderson | 454/212 |
| 2,713,398 | 7/1955 | Blum et al. . | |
| 3,051,230 | 8/1962 | Hart . | |
| 3,204,548 | 9/1965 | McCabe . | |
| 3,381,601 | 5/1968 | McCabe . | |
| 3,443,366 | 5/1969 | Schwab . | |
| 3,456,573 | 7/1969 | Painter . | |
| 4,022,117 | 5/1977 | Mallian . | |
| 4,081,915 | 4/1978 | Materniak et al. . | |
| 4,090,436 | 5/1978 | Wright . | |
| 4,151,789 | 5/1979 | Grobard | 454/359 |
| 4,214,380 | 7/1980 | Meyer . | |
| 4,445,426 | 5/1984 | Bohanon, Sr. | 454/353 X |
| 4,920,867 | 5/1990 | Joly . | |
| 4,967,490 | 11/1990 | Berger et al. . | |
| 5,046,408 | 9/1991 | Eugenio . | |
| 5,167,578 | 12/1992 | Legault . | |
| 5,383,816 | 1/1995 | Marcello et al. . | |
| 5,482,507 | 1/1996 | Priest . | |
| 5,498,204 | 3/1996 | Anderson et al. . | |
| 5,547,422 | 8/1996 | Seboldt . | |
| 5,568,947 | 10/1996 | Paquette . | |
| 5,591,080 | 1/1997 | Ward . | |
| 5,675,908 | 10/1997 | Barnes | 454/367 X |
| 5,722,181 | 3/1998 | Meyer | 454/359 X |

FOREIGN PATENT DOCUMENTS 0043504 1/1982 European Pat. Off. .

OTHER PUBLICATIONS

Deflecto Corporation, "'94 Hardware Catalog",1994.

*Primary Examiner*—Harold Joyce
*Attorney, Agent, or Firm*—Woodard, Emhardt, Naughton Moriarty & McNett

[57] ABSTRACT

An exhaust vent for routing dryer exhaust from within a structure to outside of the structure includes a unitary vent hood which is designed to be mounted to an outer wall of the structure. The vent hood includes a rear wall which defines a substantially circular exhaust aperture. Surrounding the exhaust aperture is a generally cylindrical connecting portion which is designed to receive a flexible exhaust conduit. A forward wall of the vent hood in combination with the rear wall defines a downwardly and forwardly directed exit opening. A hinged flapper is received by the rear wall of the vent hood for closing the exhaust aperture against outside air when exhaust from the dryer is not flowing through the aperture. In a larger designed embodiment of the exhaust vent, the flapper is replaced by a pair of overlapping and hinged louvers. The exit opening is covered by a grid-like guard which snaps onto the vent hood. The grid-like guard defines a substantially uniform pattern of grid openings for allowing the exhaust to flow freely therethrough. The guard is designed so as to prevent the nesting of birds and small animals inside of the vent hood. Three snap-in/ snap-on designs are disclosed involving a substantially planar guard. In another embodiment the substantially planar guard is replaced by a basket guard which creates a larger volume between the guard and the exit opening which permits lint and debris to be collected.

18 Claims, 15 Drawing Sheets

HOODED EXHAUST VENT

BACKGROUND OF THE INVENTION

The present invention relates in general to venting and conduit devices for routing exhaust from within a structure to a remote location outside of the structure. More specifically the present invention relates to the design of a hooded exhaust vent for routing the exhaust from a clothes dryer to the outside atmosphere. The hooded vent is designed to be attached to a wall panel or window panel (pane removed) and extends outwardly into the outside atmosphere.

The exhaust from a clothes dryer is typically routed to the outside atmosphere by means of a flexible conduit and some type of vent member. The exit location from the corresponding structure is typically an outside wall of the structure or a window panel with the glass pane removed. The flexible conduit is secured to the exhaust conduit of the clothes dryer and then routed to the exit location. At the exit location a flow opening or passageway is created in the structure wall or window panel and a suitable vent is mounted into, onto, or across the exit flow opening. In order to substantially prevent the inflow or backflow of outside air, as well as to prevent the entry of moisture which may be due to rain or snow, exhaust vents of this type may be covered with a hood and would include a one-way or hinged flapper or a series of hinged louvers secured within a surrounding frame.

The following listed patents provide a representative sampling of these earlier vent designs:

| PATENT NO. | PATENTEE | ISSUE DATE |
|---|---|---|
| 5,167,578 | Legault | Dec. 1, 1992 |
| 5,383,816 | Marcello et al. | Jan. 24, 1995 |
| 5,498,204 | Anderson et al. | Mar. 12, 1996 |
| 4,214,380 | Meyer | Jul. 29, 1980 |
| 4,081,915 | Materniak et al. | Apr. 4, 1978 |
| 3,204,548 | McCabe | Sep. 7, 1965 |

One of the concerns with external vent hoods which open out into) the atmosphere is that they create a protected, warm location for birds and small animals to nest. The building of a nest in this area can block the flapper or louvers from freely opening in response to exiting exhaust air from the clothes dryer. If this situation occurs and persists, it will interfere with the operation of the clothes dryer and could create a risk of fire. Even if the flapper or louvers are operable, an open and unguarded conduit provides an entrance path into the structure for birds and small animals.

One self-help remedy to try and prevent the nesting of birds and small animals is to create a wire screen and place it over the exit opening of the hood or across the louver frame. Starting with a panel of wire screen material, it can be cut to size and bent into a shape which would roughly fit the exit opening of the hood or the louver frame. The problem with this approach is that there is no convenient way to secure the formed wire panel on or around the vent. Depending on the skill of the individual in cutting and bending the wire screen material, this hand-made approach could be somewhat unsightly and the entire process is awkward enough that many homeowners would not be inclined nor willing to try and Rube Goldberg something together. Even if the wire screen panel is taped in place, this simply further detracts from the appearance which should be a concern because the vent, or at least the hood portion, is on the outside of the structure. Accordingly, this type of approach represents something less than a desirable modification.

It would therefore be an improvement to hooded dryer exhaust vent designs to provide an attractively styled, matching and securely attached guard over the exit opening of the dryer exhaust vent so that birds and small animals cannot nest inside the hood nor gain access to the area adjacent to the vent flapper or vent louvers. Such a guard is provided by the present invention and is designed so as to be removable and able to be readily assembled to the hood with a snap-fit. Accordingly, the guard design of the present invention is efficient, attractive, reliable, and cost effective. With an open grid design for the guard, there is an unrestricted, free flow of exhaust from the clothes dryer while still providing a suitable barrier to the entry of birds aid small animals and a suitable barrier to the nesting of birds and small animals. The present invention provides this efficient, attractive, reliable, and cost effective design in a novel and unobvious manner.

SUMMARY OF THE INVENTION

An exhaust vent for routing exhaust from a first location within a structure to a second location outside of the structure according to one embodiment of the present invention comprises a unitary vent hood including a rear wall defining therein an exhaust aperture, a connecting portion positioned around the exhaust aperture for the assembly of an exhaust conduit, and a forward wall which in cooperation with the rear wall defines an exit opening. The exhaust vent further includes flow control means disposed over the exhaust aperture and being constructed and arranged for permitting flow therethrough in substantially only an exiting direction and a unitary guard for covering over the exit opening, the guard including a plurality of projections for the snap-fit assemble of the guard to the vent hood.

One object of the present invention is to provide an improved hooded exhaust vent.

Related objects and advantages of the present invention will be apparent from the following description.

DESCRIPTION OF THE PREFERRED EMBODIMENT

Figure 1:
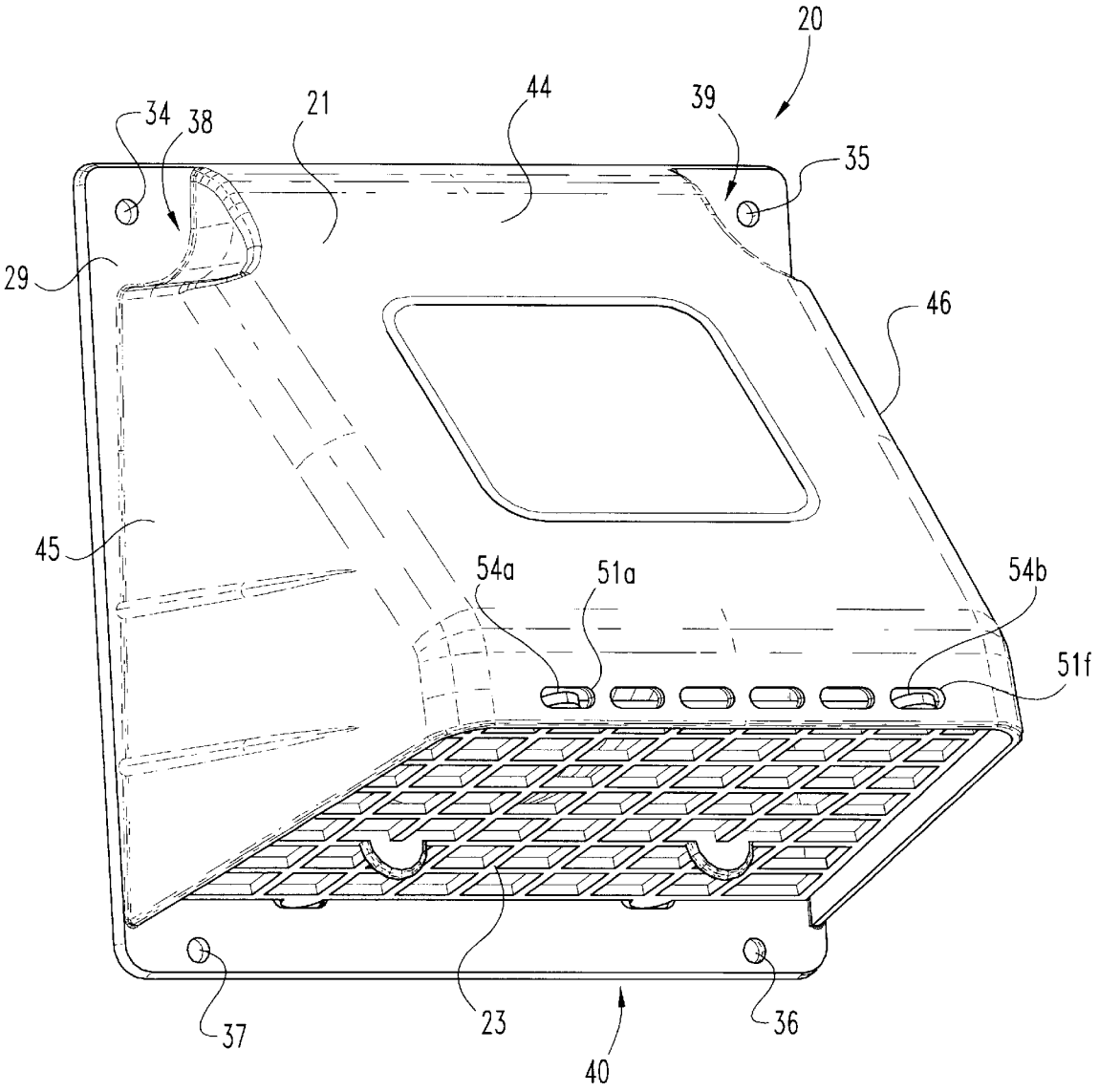
FIG. 1 is a perspective view of a hooded exhaust vent according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
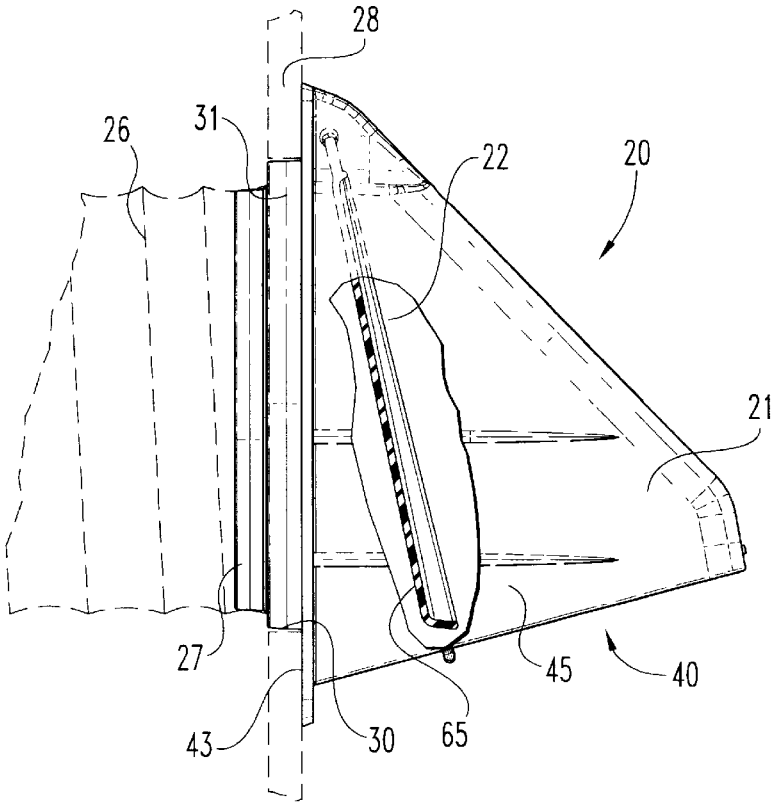
FIG. 2 is a fragmentary, side elevational view of the FIG. 1 hooded exhaust vent.
Figure 3:
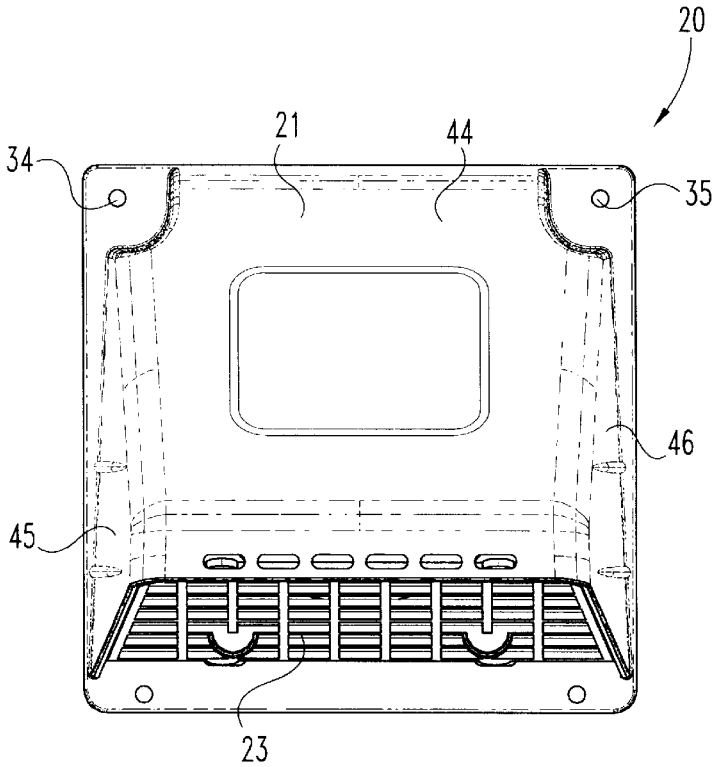
FIG. 3 is a front elevational view of the FIG. 1 hooded exhaust vent.
Figure 4:
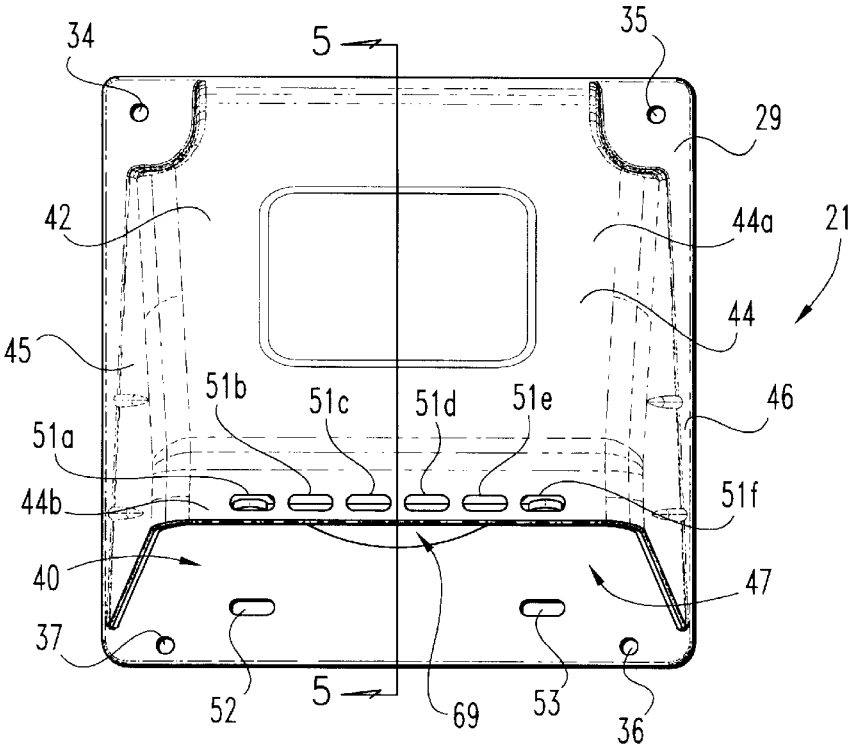
FIG. 4 is a front elevational view of the hood which comprises a portion of the FIG. 1 hooded exhaust vent.
Figure 5:
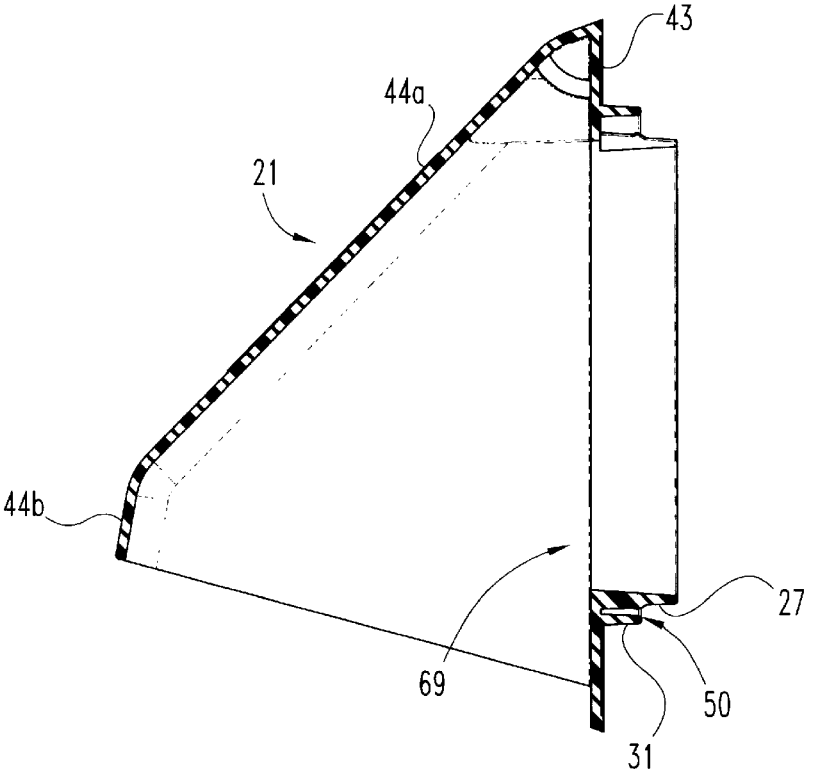
FIG. 5 is a side elevational view in full section of the FIG. 4 hood.
Figure 6:
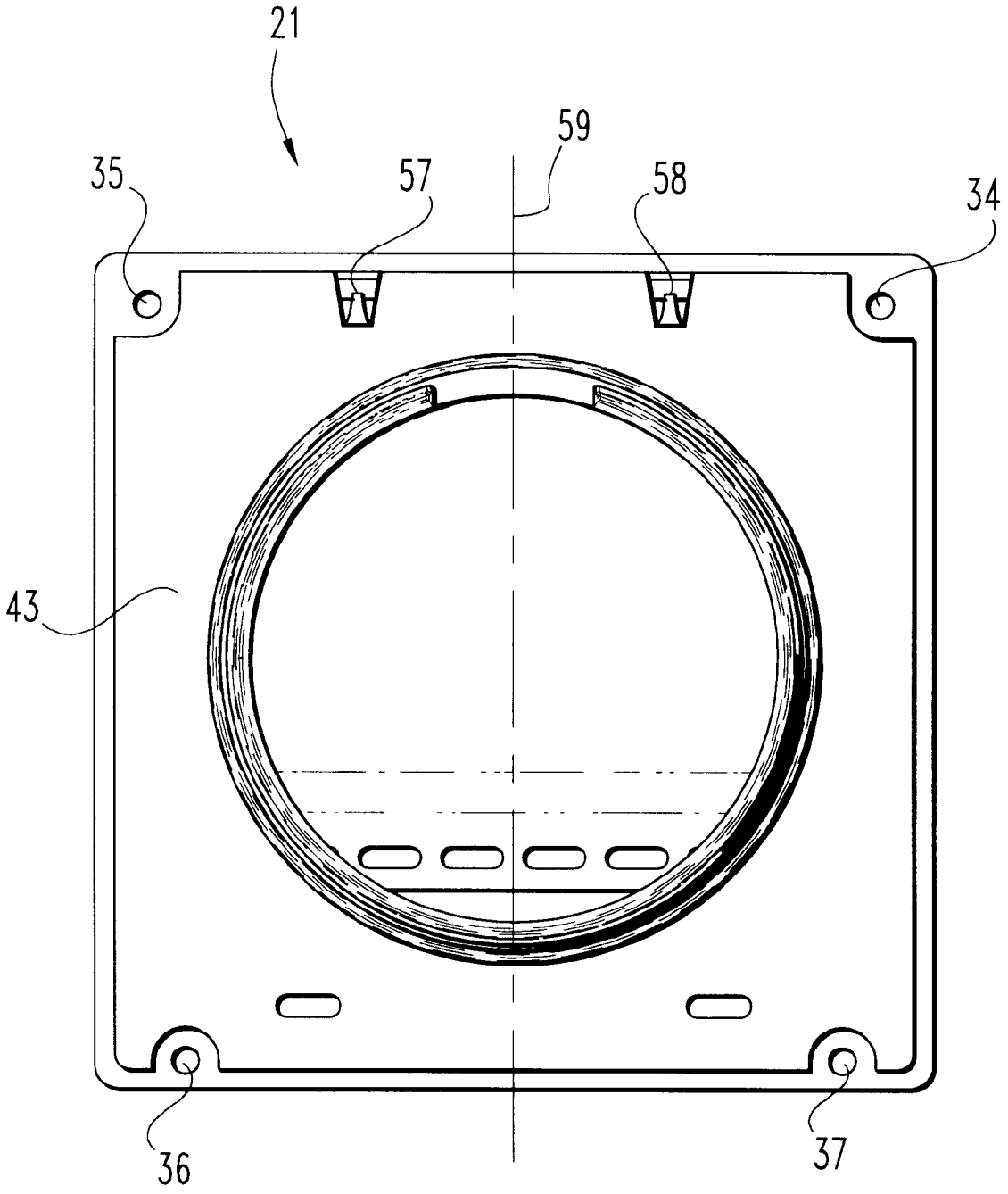
FIG. 6 is a rear elevational view of the FIG. 4 hood.
Figure 7:
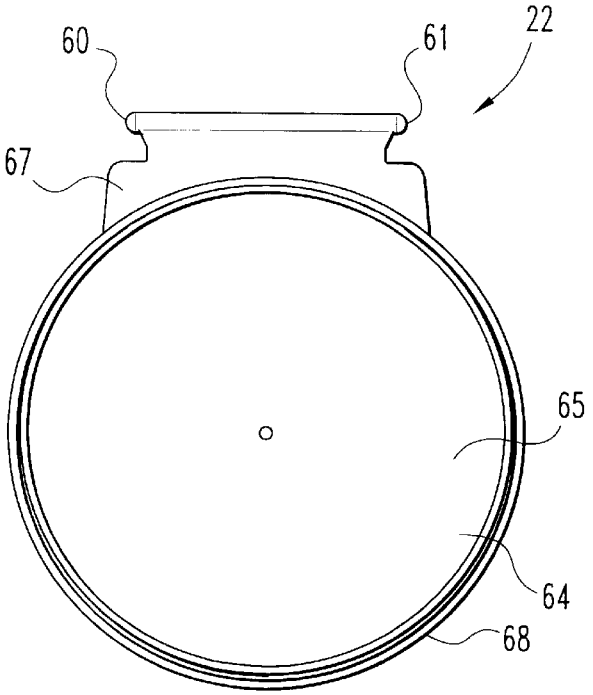
FIG. 7 is a front elevational view of a flapper which comprises one portion of the FIG. 1 hooded exhaust vent.

Referring to FIGS. 1–3, there is illustrated a hooded exhaust vent 20 which is a snap-fit assembly of three components. The three components include a unitary, molded plastic hood 21, a unitary, molded plastic flapper 22, and a unitary, molded plastic guard 23. The hooded exhaust vent 20 is designed to be used in conjunction with a clothes dryer and the exhaust conduit from that clothes dryer. Vent 20 is also designed to be mounted to a structural wall or window panel for directing the exhaust from the clothes dryer to the outside atmosphere. As will be described in created detail, the flapper 22 is hinged to the hood in an easily installed manner such that the flapper pivots outwardly in response to the flow of exhaust from the clothes dryer. The guard 23 snaps into the hood 21 so as to close off access to the interior of the hood.

As is illustrated in FIG. 2, an exhaust conduit 26 (broken line form) is attached to the substantially cylindrical rim 27 in order to route dryer exhaust to the hooded vent 20 for discharge into the outside atmosphere. Attachment of the flexible conduit to rim 27 may be accomplished by means of a band clamp or by use of tape. Wall 28 represents the wall of the structure or alternatively a panel as might be installed in a window once a glass pane is removed. While there are various options for providing an exit path from within the structure to the outside atmosphere, these options and the manner of creating a suitable opening are believed to be well known to those of ordinary skill in the art. With each of the options for providing an exit path for the dryer exhaust and the necessary opening in the structure wall or window panel, there is a preferred way of attaching or mounting the hooded vent 20.

One option for attaching the hooded vent is to use a structural adhesive or sealant and mount the rear flange 29 of the hooded vent 20 directly to the wall or panel 28 which defines opening 30 which in turn receives cylindrical portion 31. Another option is to use threaded fasteners and the four clearance holes 34–37 which are disposed in rear flange 29 are provided for this purpose. The upper corners of hood 21 are configured with relief areas 38 and 39 in order to provide clearance for the fasteners which are inserted into holes 34 and 35, respectively. The two lower holes 36 and 37 are accessible through exit opening 40 of hood 21 before guard 23 is snapped into position.

Referring to FIGS. 4–7, the hood 21 is illustrated in detail. Hood 21 which is a unitary, molded member includes a substantially flat rear wall 43 which includes flange 29 and a forward wall 42 which includes front wall 44, and sidewalls 45 and 46. In general the rear wall 43 and the forward wall 42 define the hollow interior of the hood 21 as well as the exit opening 40. Since the forward wall can assume various shapes, the specific style illustrated is but one option. With regard to the specific style of wall 42 which includes walls 44–46, these walls define the hollow interior 47 and the lower edges of walls 44, 45, and 46 in combination with flange 29 define exit opening 40. Each of the sidewalls 45 and 46 lave a slight inward taper of between 5 and 8 degrees in the direction of front wall 44. This creates a trapezoid shape for exit opening 40. Front wall 44 includes an angled first portion 44*a* which extends forwardly while it extends downwardly. First portion 44*a* bends into lower portion 44*b* which extends downwardly at an angle which is closer to parallel with the rear wall 43.

Rim 27 is generally cylindrical with a slight taper of approximately 4 degrees on its inside diameter surface. Cylindrical portion 31 is substantially concentric with the outside diameter of rim 27 and a substantially cylindrical channel 50 is created by the concentric nature and spacing of rim 27 and cylindrical portion 31. Rim 27 and portion 31 can be sized in a number of ways to accept either a standard 3 inch or standard 4 inch exhaust conduit. As would be understood, depending on the sizing of the exhaust conduit 26, this conduit can be inserted either into rim 27, around rim 27 which would amount to placing the conduit into channel 50, or around the outside diameter of cylindrical portion 31. Each of the locating options for exhaust conduit 26 would naturally involve various options for securing the exhaust conduit 26 to the vent 20.

The lower portion of front wall 44 includes a series of six oblong apertures 51*a*–51*f*. Two additional oblong apertures 52 and 53 are disposed in the lower portion of rear wall 43. The two end apertures 51*a* and 51*f* in cooperation with apertures 52 and 53 receive snap-in tabs 54*a*–54*d* which are integrally molded as part of guard 23. Due in part to the flexibility of guard 23 and due in part to the sizing of the four tabs 54*a*–54*d*, guard 23 is able to flex to a sufficient degree to enable the four tabs to clear the edges of exit opening 40 and thereby snap into the four receiving oblong apertures in hood 21.

Figure 8:
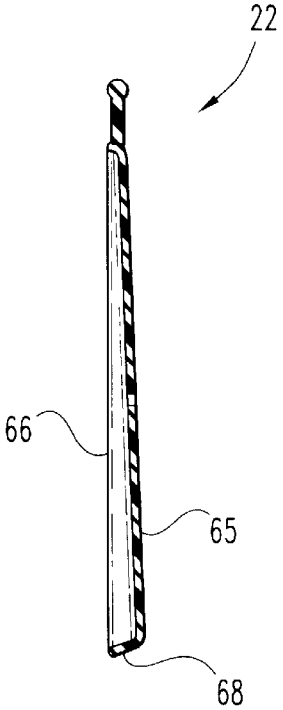
FIG. 8 is a side elevational view in full section of the FIG. 7 flapper.

Rear wall 43 includes a pair of hinge supports 57 and 58 which are equally spaced from centerline 59 which extends through the axis of rim 27 and through the axis of cylindrical portion 31. Each hinge support 57 and 58 is joined to rear wall 43 and each one extends inwardly into the hollow interior 47. Each hinge support 57 and 58 is curved so as to define a support surface for the hinge pins 60 and 61 of flapper 22 (see FIGS. 7 and 8). Unitary flapper 22 includes a substantially circular disk portion 64 with a substantially flat and substantially circular rear surface 65 and a substantially flat and substantially circular front surface 66. Surface 66 is set at a 2 degree angle relative to surface 65 so as to create a wedge-like shape (see FIG. 8) for disk portion 64 in lateral section. Extension 67 connects disk portion 64 with hinge pins 60 and 61. By making surface 66 slightly larger than surface 65, the outer connecting edge 68 is angled at approximately 20 degrees as it extends from surface 65 to surface 66. In use, hinge pins 60 and 61 rest on hinge supports 57 and 58, respectively. Surface 65 abuts up against circular opening 69 in rear wall 43. The inner edge of rim 27 defines opening 69. The outside diameter size of surface 65 is just slightly smaller than the inside diameter size of opening 69. In this way the rear surface 65 actually fits into opening 69 rather than against the inside surface of rear wall 43. Due to this dimensional sizing it is angled edge 68 which actually abuts up against the edge of opening 69 and the angled surface of edge 68 virtually guarantees a sealed fit at this interface. In this way, it will not be possible for the backflow of any noticeable amount of air from the outside atmosphere into conduit 26. The gravity suspension of flapper 22 from hinge supports 57 and 58 creates a freely suspended and free floating flapper which pivots outwardly and upwardly away from opening 69 whenever exhaust from the dryer is delivered through conduit 26. The greater the exiting force of the dryer exhaust, the greater the pivoting motion of the flapper. In use the rear wall 43 of hood 21 will normally be substantially vertical. When the flapper is suspended from hinge supports 57 and 58, surface 66 will also be substantially vertical. As a result, rear surface 65 is angled back into opening 69. When the dryer is not running, even if there are slight dimensional variations, the presence of edge 68 will virtually guarantee a substantially closed condition for opening 69 so that any noticeable amount of outside air cannot flow back into conduit 26. As should be understood any backflow of air with any noticeable velocity will actually push the flapper 22 into a tightly closed condition against the edge of opening 69.

Figure 9:
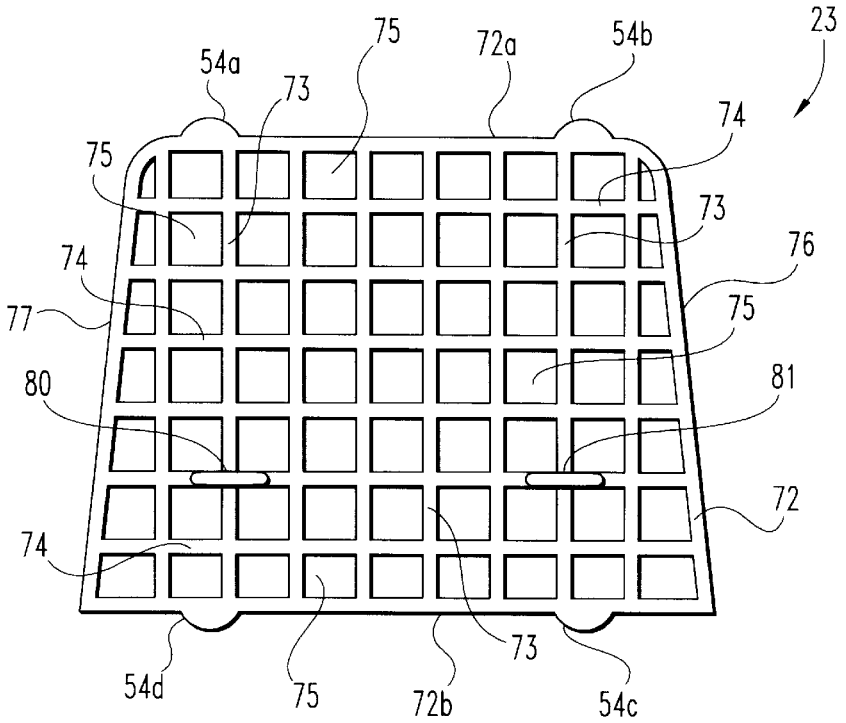
FIG. 9 is a bottom plan view of a guard which comprises one portion of the FIG. 1 hooded exhaust vent.
Figure 10:
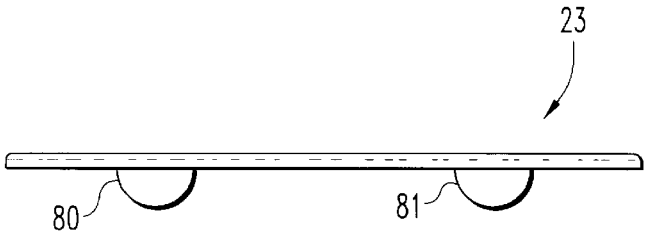
FIG. 10 is a front elevational view of the FIG. 9 guard.
Figure 11:
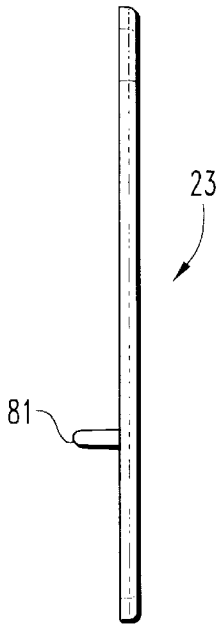
FIG. 11 is a side elevational view of the FIG. 9 guard.

Guard 23 which is illustrated in greater detail in FIGS. 9, 10, and 11, is a substantially planar, unitary plastic panel with an open grid design. Guard 23 includes surrounding outer edge 72 consisting of front edge 72*a*, rear edge 72*b* and side edges 76 and 77 and is molded with a series of spaced-apart substantially parallel grid bars 73 extending in a first direction and a cooperating series of spaced-apart, substantially parallel grid bars 74 extending in a second direction. The two series of bars 73 and 74 are arranged so as to be substantially perpendicular to each other so as to define a substantially uniform pattern of substantially uniform square grid openings 75. The row of edge openings along sides 76 and 77 are not square and have a tapering shape and a decreasing size due to the taper of sides 76 and 77 which is intended to match the taper of the hood sidewalls 45 and 46. Snap-in tabs 54*a*–54*d* are provided in an outwardly extended, or integral orientation relative to front edge 72*a* (tabs 54*a* and 54*b*) and rear edge 72*b* (tabs 54*c* and 54*d*) for receipt by apertures 51*a*, 51*f*, 52 and 53. The snap-in fit of guard 23 into hood 21 provides a barrier over exit opening 40 and prevents the nesting of birds and small animals inside of hood 21. As would be understood, guard 23 is sized to fit within opening 40, but without any substantial clearance along the outer edge of the guard which might offer a path or entrance into the hood for birds and/or small animals. Finger tabs 80 and 81 are provided for grasping the guard when it is being installed as well as when it is being removed from the hood.

Figure 12:
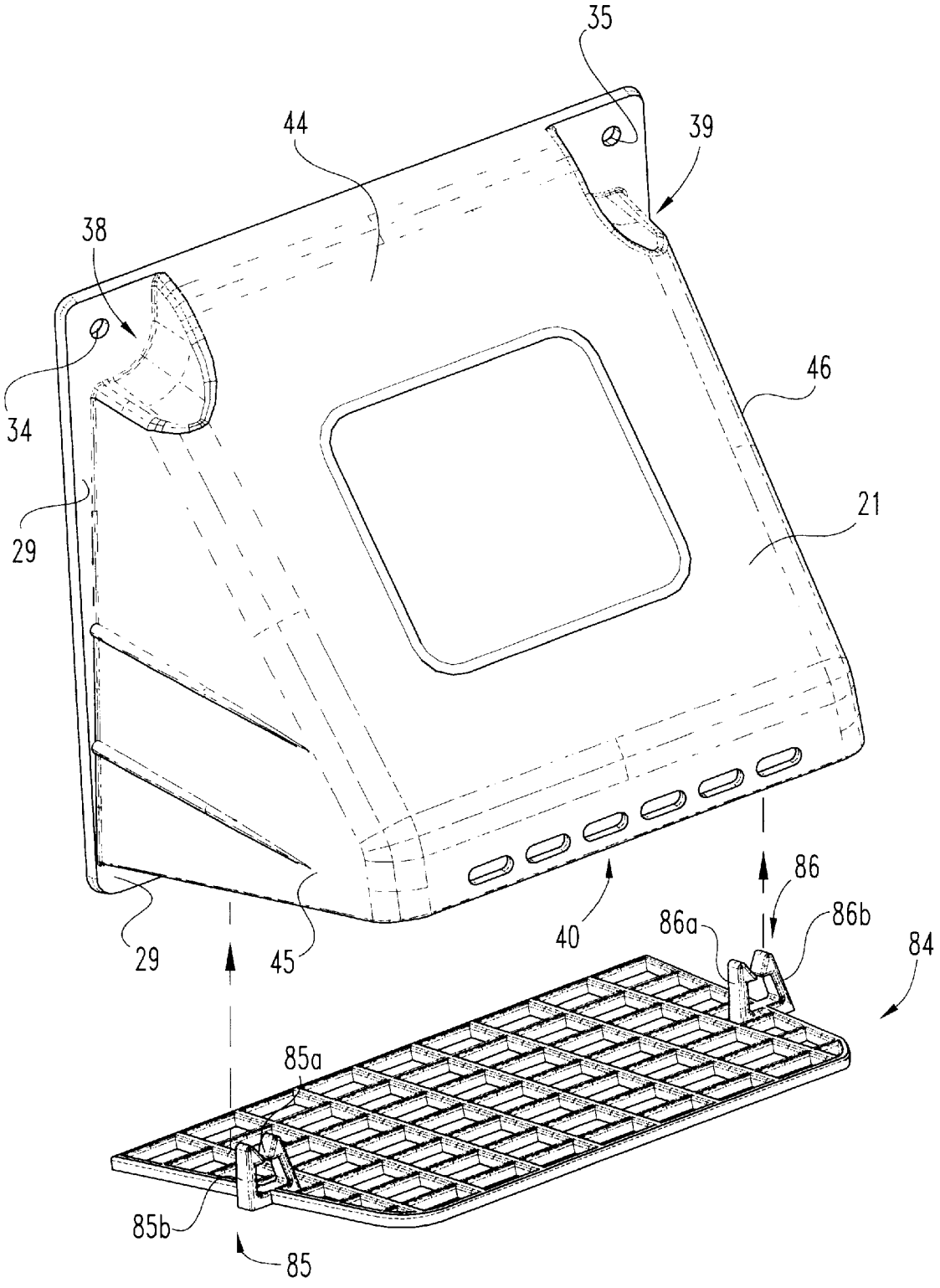
FIG. 12 is an exploded, perspective view of the FIG. 4 hood in combination with a clip-on guard according to another embodiment of the present invention.
Figure 13:
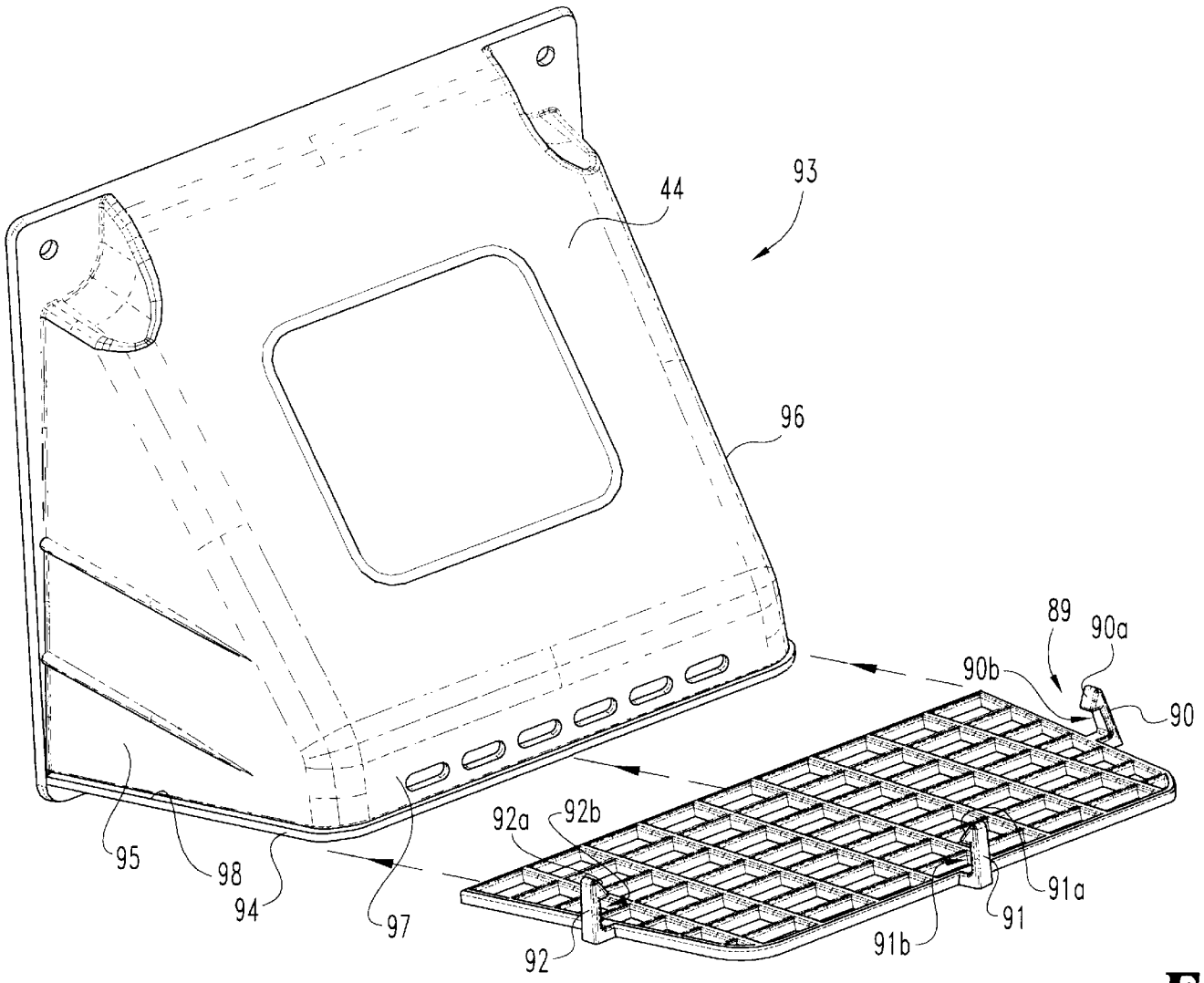
FIG. 13 is an exploded, perspective view of the FIG. 4 hood in combination with a slide-on guard according to another embodiment of the present invention.
Figure 14:
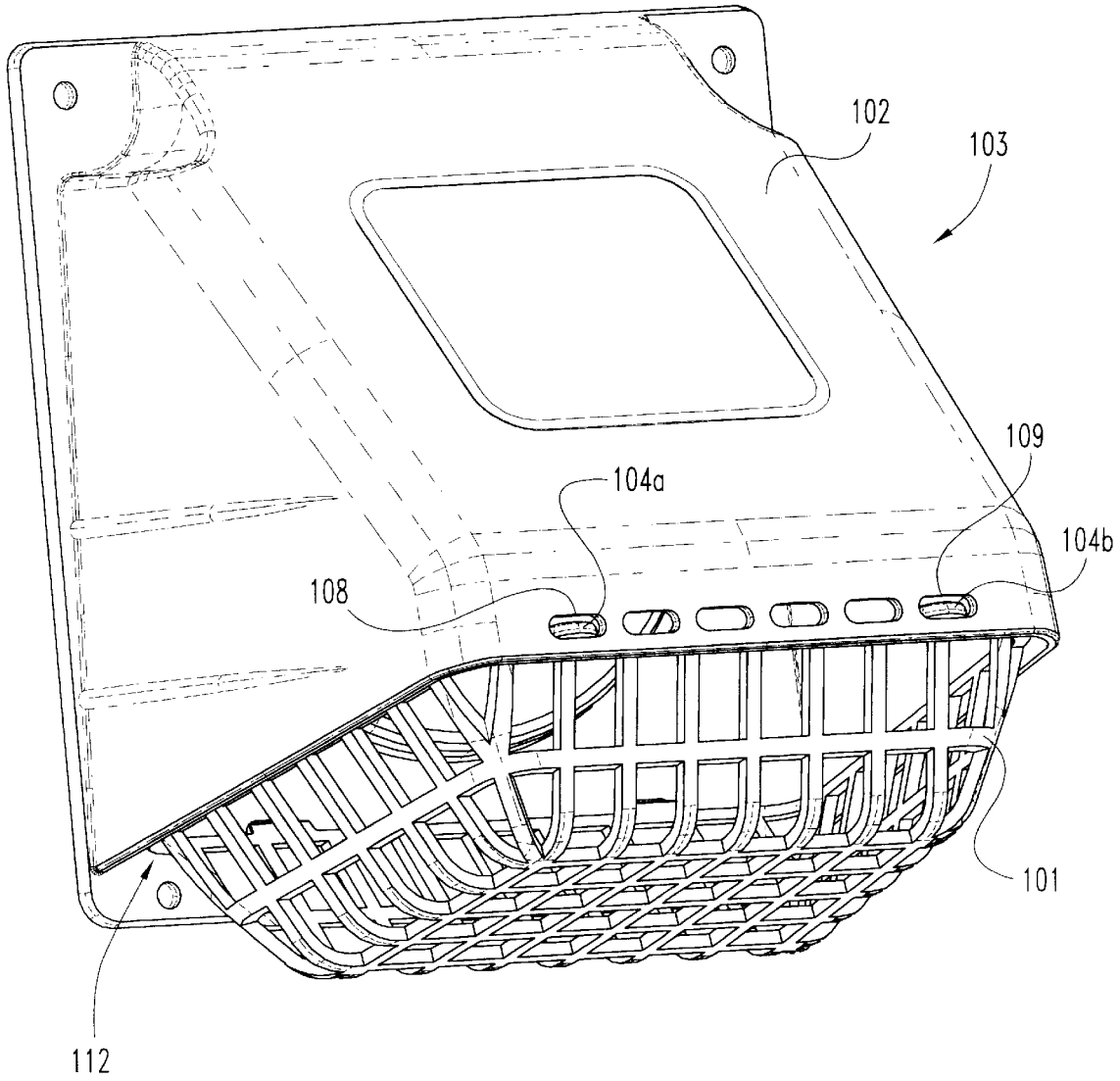
FIG. 14 is a perspective view of a hooded exhaust vent with a snap-in basket guard according to another embodiment of the present invention.
Figure 15:
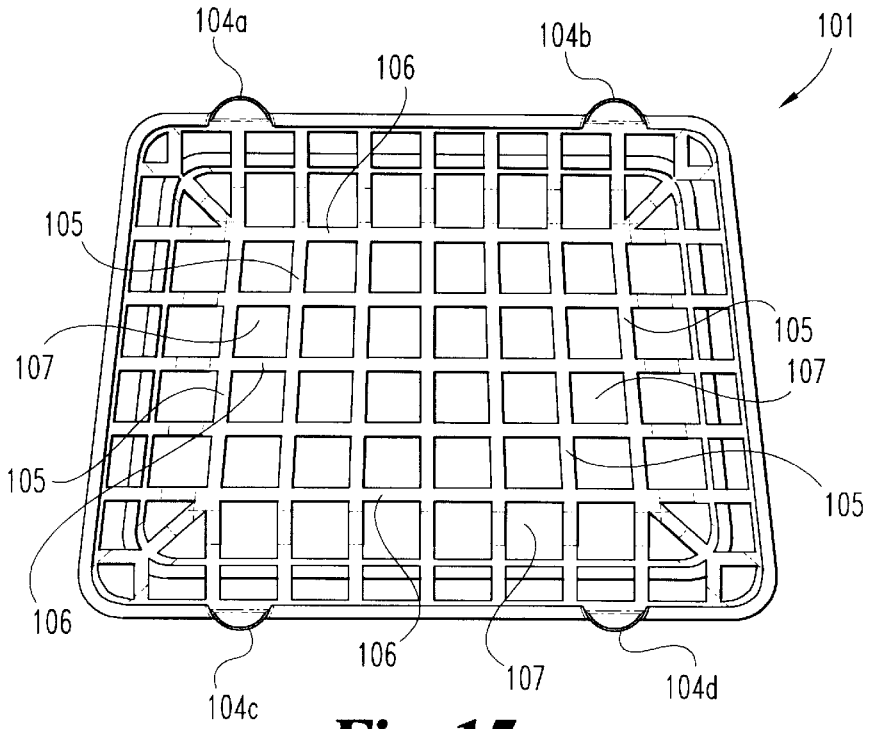
FIG. 15 is a bottom plan view of the FIG. 14 basket guard according to the present invention.
Figure 16:
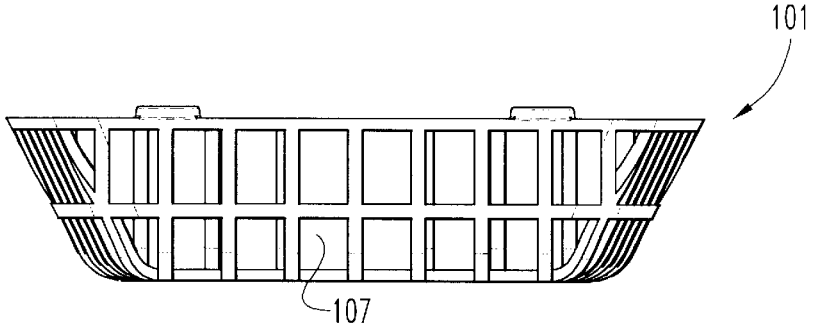
FIG. 16 is a front elevational view of the FIG. 15 basket guard.
Figure 17:
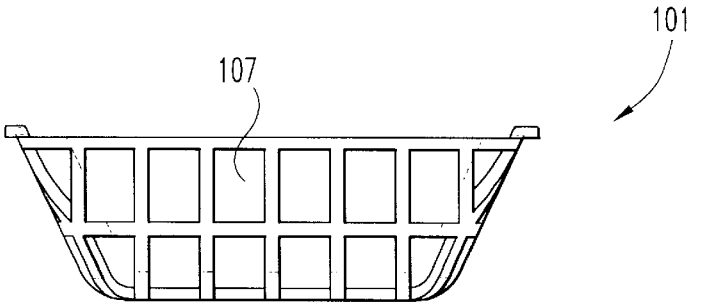
FIG. 17 is a side elevational view of the FIG. 15 basket guard.

While guard 23 is designed to permit the free flowing exit of dryer exhaust and prevent the nesting of birds or small animals in the hood 21 or around the exit opening 40 which could interfere with the movement of flapper 22, other guard designs are contemplated. With reference to FIGS. 12, 13, and 14, alternative guard designs according to the present invention are illustrated.

In FIG. 12, guard 84 is virtually identical to guard 23 in size, shape, and function except that the four edge tabs 54*a*–54*d* of guard 23 have been replaced by snap-on clips 85 and 86. Clips 85 and 86 are each designed with two opposing clip arms 85*a* and 85*b* for clip 85 and 86*a* and 86*b* for clip 86. Each clip is normally oriented so that the corresponding clip arms of each clip are almost touching but can be sprung apart when the guard is pushed up against exit opening 40 and the sidewalls 45 and 46 are pushed into clips 85 and 86, respectively. As should be understood, the spacing between the centerlines of clips 85 and 86 coincides with the centerline spacing of sidewalls 45 and 46 so that the sidewalks are centered relative to the two clips and can be pushed into the corresponding clips. The spring tension on the clip arms, which is created when those arms are spread apart, causes the spring arms to try and push back together, thereby creating a clamping force on each of the hood sidewalls. This arrangement holds the guard 84 in position across exit opening 40.

In FIG. 13, guard 89 is virtually identical to guard 23 in size, shape and function except that the four edge tabs 54*a*–54*d* of guard 23 have been replaced by slide-on clips 90, 91, and 92. Each clip includes a projecting tip design with an interlocking edge 90*a*, 91*a*, and 92*a* and a cooperating undercut relief area 90*b*, 9*b*, and 92*b*. In order for clips 90–92 to be effective in holding the guard 89 onto hood 93, a small ledge 94 needs to be provided generally around the forward wall of hood 93 and specifically along the lower edges of sidewalls 95 and 96 and along front wall 97. As will be understood, hood 93 is virtually identical to hood 21 with the exception of ledge 94 being added around the front and side lower edge periphery of the hood.

In use, the unitary guard 89 simply slides onto the ledge such that interlocking edges 90*a*, 91*a*, and 92*a* fit against the top surface 98 of ledge 94. Concurrently the ledge 94 fits within the undercut relief areas 90*b*, 91*b*, and 92*b*. Alternatively, the guard 89 may be pushed upwardly from beneath the exit opening of hood 93. If this method of assembly is used, clips 90–92 simply deflect outwardly when the ledge is encountered by each of the tips of the three clips and then the clips spring back so that the interlocking edges 90*a*, 91*a*, and 92*a* clamp onto the top surface 98 of ledge 94.

Wits continued use of the dryer, it is possible for lint and related debris to be discharged through conduit 26 into the hooded exhaust vent. While the amount of lint discharged at any one time is not significant, it is possible for a noticeable buildup to amass after several months of use. Since not all of the discharged lint and debris is able to pass through the grid openings in the various guards, there can be a buildup on the inside of the hood. If this buildup is left unattended, it would be possible for the amount to actually interfere with the free movement of the hinged flapper or with the free movement of louvers if that design is present. Obviously the present invention is designed to permit the various guards to be easily removed from their corresponding hood so that the guards can be cleaned and then reassembled into the hood. When the guard is removed, the inside of the hood and the area around the flapper can also be cleaned.

Since routine household tasks of the type described are not always performed in a timely fashion, it is conceivable that the job of removing the guard and cleaning the dryer exhaust vent will not be performed before the lint buildup becomes excessive. In order to address this possibility, the present invention contemplates a basket design for the dryer exhaust vent guard which creates a much larger collection area for discharged lint and related debris. This in turn means that a substantially longer period of time can pass before the build up might become sufficient enough to actually interfere with either the operation of the flapper or with the free and unobstructed discharge of dryer exhaust into the outside atmosphere.

Referring now to FIGS. 14–17, a basket guard 101 is illustrated as it would be designed and arranged to be snapped into hood 102 as part of dryer exhaust vent 103 according to the present invention. It is to be noted that hood 102 is virtually identical to hood 21 and in effect the only difference between vent 20 and vent 103 is the replacement of guard 23 with basket guard 101. A comparison of FIGS. 9 and 15 reveals the similarities between guard 23 and basket guard 101. These two guards are similar in numerous respects except for the deep draw of basket guard 101 as detailed by FIGS. 16 and 17.

Basset guard 101 is a unitary member with snap-in tabs 104*a*–104*d* intersecting grid bars 105 and 106, which define grid openings 107. While the various grid openings have a more varied combination of shapes and sizes, the use and function of basket guard 101 is virtually the same as that of guard 23. Due to the depth of guard 101, there is no need for finger tabs 80 and 81. The depth and size of guard 101 is sufficient to enable the easy handling and manipulation of the guard 101 whether it is being installed or removed from the hood. The two front tabs 104*a* and 104*b* snap into front apertures 108 and 109. Rear tabs 104*c* and 104*d* snap into two cooperating rear apertures (not shown) which generally correspond in size and location to oblong apertures 52 and 53. By use of the four tabs and the apertures as described, the basket guard 101 is positioned over exit opening 112 and is securely held in place on hood 102.

The style of snap-in tabs 104*a*–104*d* and their method of use relative to the assembly of basket guard 101 into hood 102 is virtually identical to tabs 54*a*–54*d* on guard 23 and its assembly into hood 21. In a similar fashion, basket guard 101 can be reconfigured so as to replace the four tabs 104*a*–104*d* with two snap-on clips of the same style and arrangement as clips 85 and 86 which are associated with guard 84. Alternatively, basket guard 101 can be reconfigured so as to replace either the four tabs 104*a*–104*d* or the two snap-on clips 85 and 86 with slide-on/snap-on clips 90, 91, and 92 which are associated with guard 89. According to the present invention there are three flat plate guard styles according to the embodiments of FIGS. 1–13 and three corresponding basket guard styles, one of which is illustrated in FIGS. 14–17. The basket guard 101 in cooperation with the front wall and side walls of the hood 102 define an enlarged interior volume for the collection of lint and debris as described.

Figure 19:
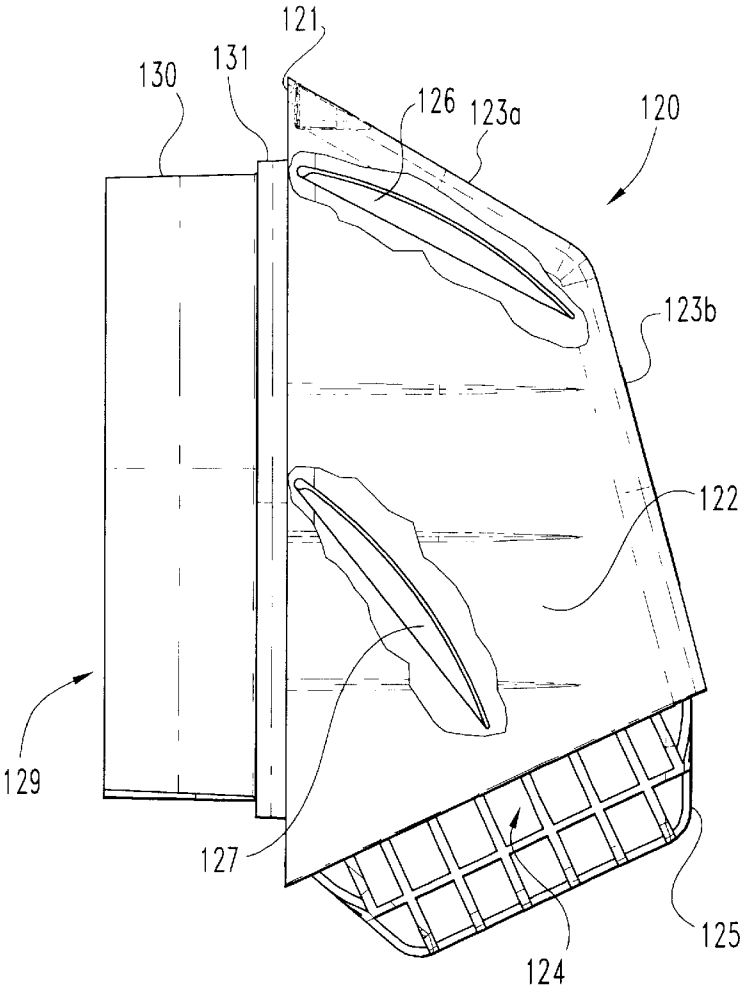
FIG. 19 is a fragmentary, side elevational view of the FIG. 18 hooded exhaust vent.
Figure 18:
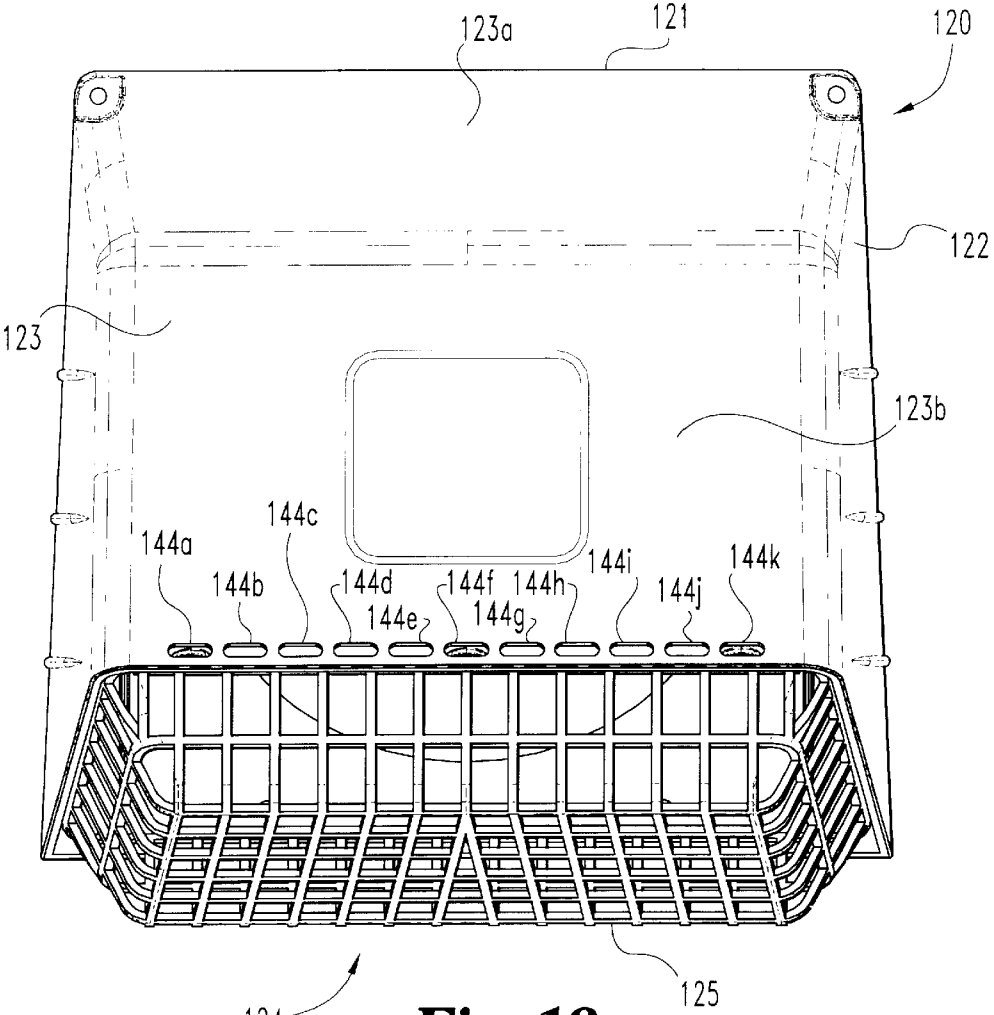
FIG. 18 is a front elevational view of a hooded exhaust vent according to another embodiment of the present invention.
Figure 20:
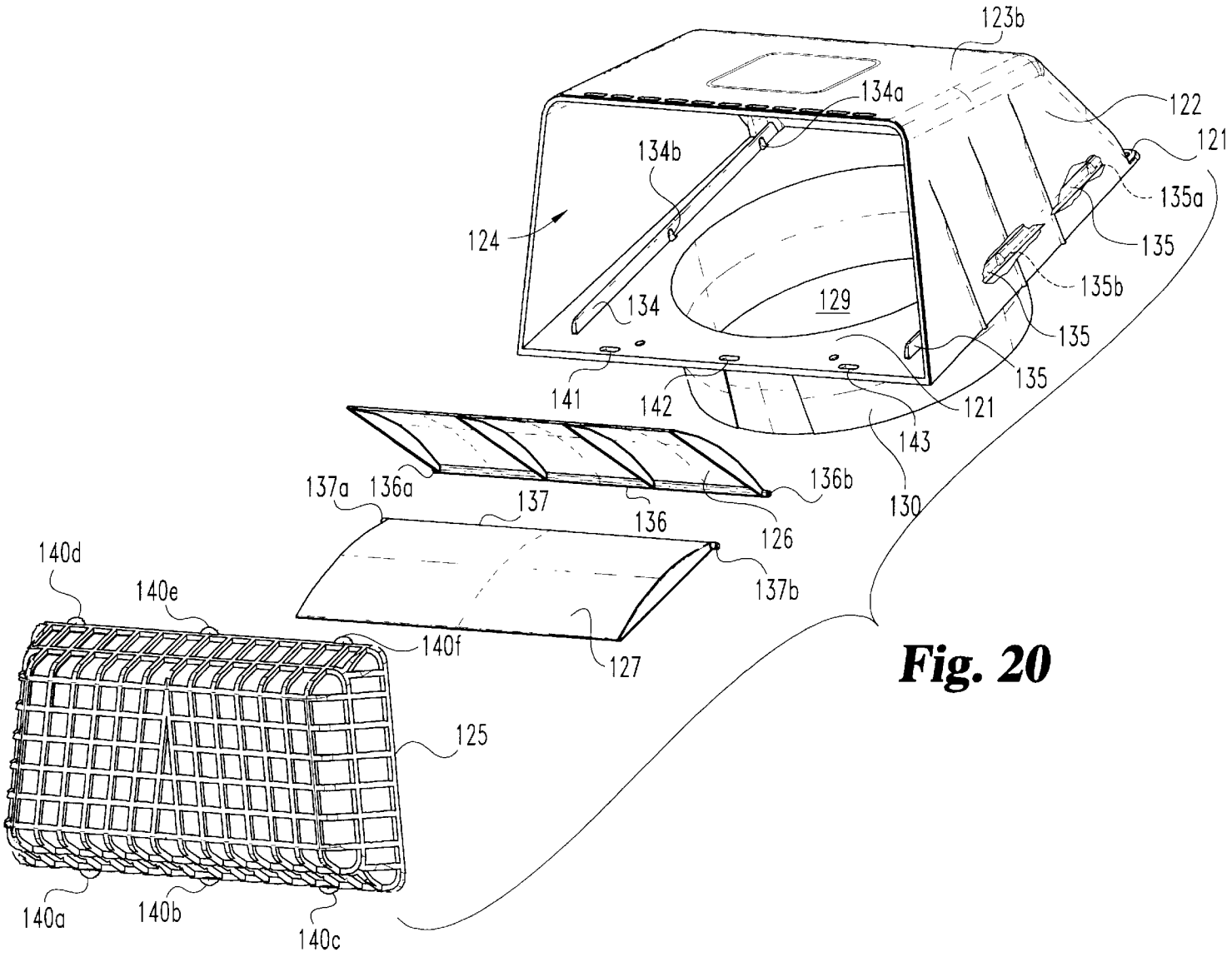
FIG. 20 is an exploded view of the FIG. 18 hooded exhaust vent.

Referring to FIGS. 18, 19, and 20, a dryer exhaust vent 120 according to the present invention is illustrated. Vent 120 is a hooded exhaust vent and is essentially the same style and construction as the basket guard version of vent 20 with four primary differences. First, vent 120 is wider than vent 20 by approximately 4.5 inches. At its widest point along the rear wall 43, hood 21 measures approximately 5.2 inches. At its widest point along the rear wall 121, hood 122 measures approximately 9.7 inches.

The second primary difference is that the rear wall 121 of vent 120 is higher than the rear wall 43 of vent 20 by approximately 3.6 inches. The height of rear wall 121 is approximately 8.9 inches while the height of rear wall 43 is approximately 5.3 inches. While both rear walls are roughly square in shape, the front walls 44 and 123 have a different geometry. Front wall 44 of hood 21 has a relatively large inclined first portion 44*a* which bends into a substantially smaller lower portion 44*b*. In contrast, the forwardly-extending length of the first portion 123*a* is relatively short. When portion 123*a* bends into lower portion 123*b*, it causes the exit opening 124 to maintain a relatively small front to rear dimension. The result is a shape for opening 124 which is substantially rectangular though with slightly tapered sides. The size, shape, and style of basket guard 125 is similar to basket guard 101 with the exception of its rectangular shape and larger size. The differing shapes of the two front walls represents the third primary difference between the two vents.

The fourth primary difference between the two vent designs is that the flapper 22 of vent 20 is replaced with a pair of hinged louvers 126 and 127. As will be noted, the size of hood 122 is enlarged to accommodate a substantially larger circular opening 129 in rear wall 121 (surrounded by rim 130 and cylindrical portion 131) as compared to opening 69. Opening 69 measures approximately 3.7 inches in diameter while opening 129 can be as large as approximately 6.5 inches in diameter. With this large of an opening, the use of a circular flapper involves a relatively large and heavy member. In order to create a design which opens more easily, the circular flapper design is replaced by the pair of louvers 126 and 127. These two louvers are constructed and arranged to have a slight overlap with each other and to extend across circular opening 129. When exhaust air flows through the circular opening, the louvers pivot upwardly and outwardly as will be described hereinafter.

The interior of unitary hood 122 includes a pair of ribs 134 and 135, each of which define a pair of spaced-apart hinge pockets 134*a*, 134*b*, and 135*a*, 135*b*, respectively. The hinge pin portion 136 of louver 126 defines a pair of outwardly-extending ends 136*a* and 136*b*. Likewise, the hinge pin portion 137 of louver 127 defines a pair of outwardly-extending ends 137*a* and 137*b*. The two unitary louvers are able to be flexed slightly so that their hinge pin ends can snap into the corresponding receiving hinge pockets. End 136*a* fits into pocket 134*a*, end 136*b* fits into pocket 135*a*, end 137*a* fits into pocket 134*b*, and end 137*b* fits into pocket 135*b*. Ribs 134 and 135 are substantially parallel to each other and to rear wall 121. With the vent 120 mounted to a vertical wall so that the geometric plane encompassing rear wall 121 is substantially vertical, each hinge pin portion is substantially horizontal. By horizontally aligning pocket 134*a* with pocket 135*a* and by horizontally aligning pocket 134*b* with pocket 135*b*, the two louvers maintain a substantially parallel orientation relative to each other. Accordingly, the vertical spacing between pockets along the same corresponding rib is substantially equal.

Basket guard 125 includes six snap-in tabs 140*a*–140*f* for the snap-in assembly of guard 125 into hood 120. Tabs 140*a*–140*f* are virtually identical to tabs 104*a*–104*d* in size, shape, and function, except now there are six tabs in lieu of four due to the increased side-to-side length (or width) of guard 125. Rear wall 121 includes three oblong apertures 141, 142, and 143 which receive tabs 140*a*–140*c*, respectively. The lower portion 123*b* of front wall 123 includes a series of eleven oblong apertures 144*a*–144*k*. Apertures 144*a*, 144*f*, and 144*k* receive tabs 140*d*–140*f*, respectively.

The louvers 126 and 127 are designed with a slight overlap so as to completely cover opening 129. When exhaust air of sufficient velocity flows into opening 129, the two louvers pivot upwardly and outwardly so as to permit the passage of the exhaust air out through exit opening 124 and from there through basket guard 125. Guard 125 functions the same as guard 101 in order to permit exhaust air to escape while still providing a structure that prevents the nesting of birds and small animals inside the hood 122. The deep draw on the unitary basket guard 125 provides added space for the collection of lint and other debris which will not thereby interfere with the free pivoting movement of the two louvers 126 and 127.

Figure 21:
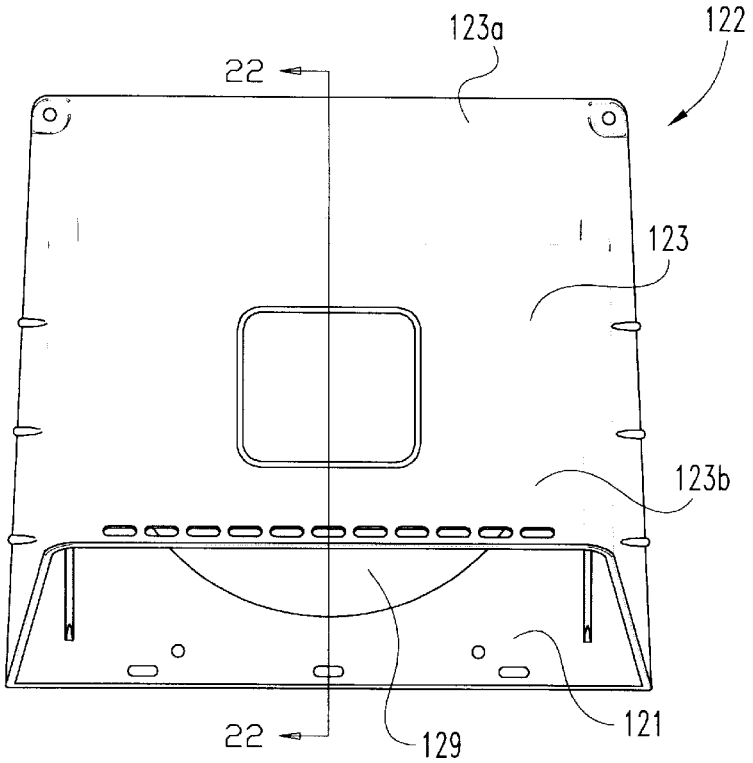
FIG. 21 is a front elevational view of the hood which comprises a portion of the FIG. 18 hooded exhaust vent.
Figure 22:
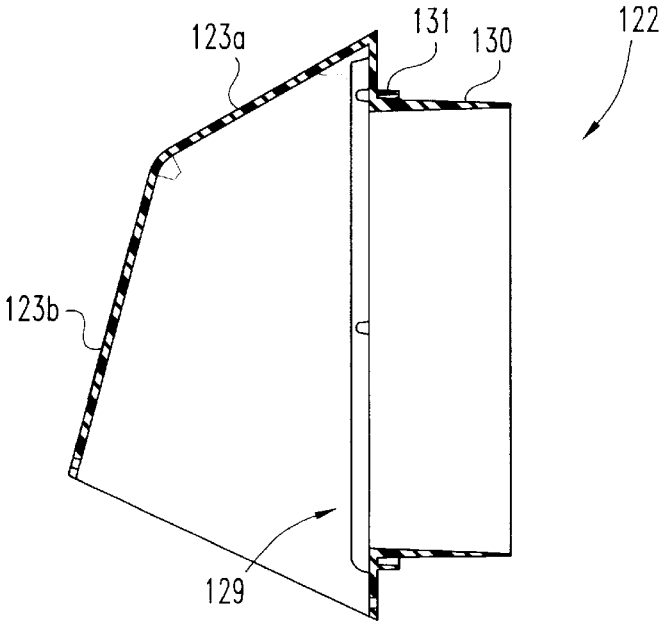
FIG. 22 is a side elevational view in full section of the FIG. 21 hood.
Figure 23:
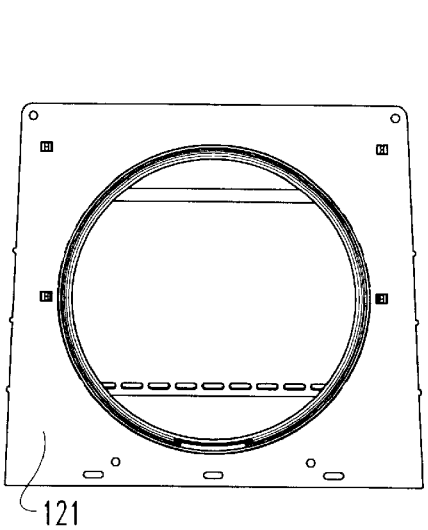
FIG. 23 is a rear elevational view of the FIG. 21 hood.
Figure 24:
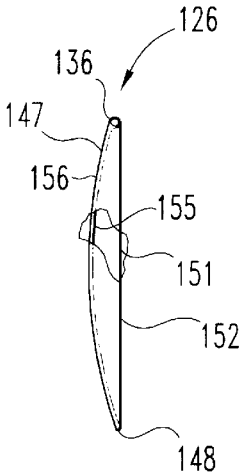
FIG. 24 is a side elevational view of a flow control louver which comprises one portion of the FIG. 18 hooded exhaust vent.
Figure 25:
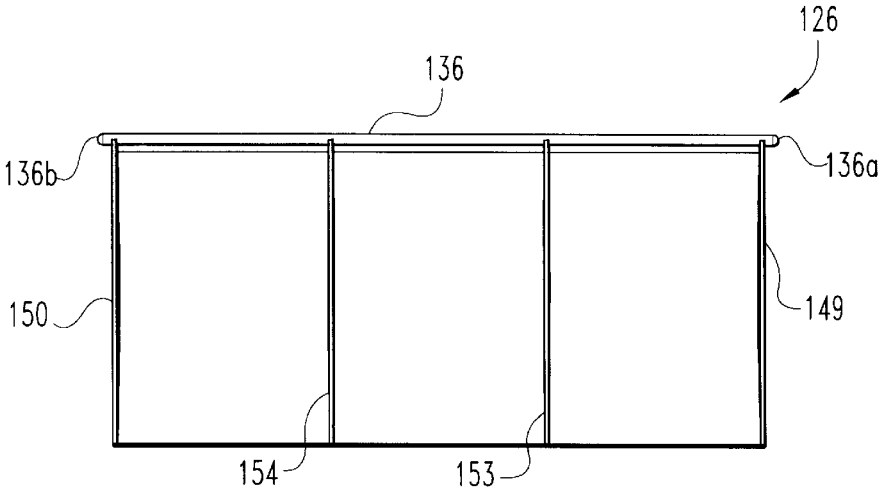
FIG. 25 is a rear elevational view of the FIG. 24 louver.
Figure 26:
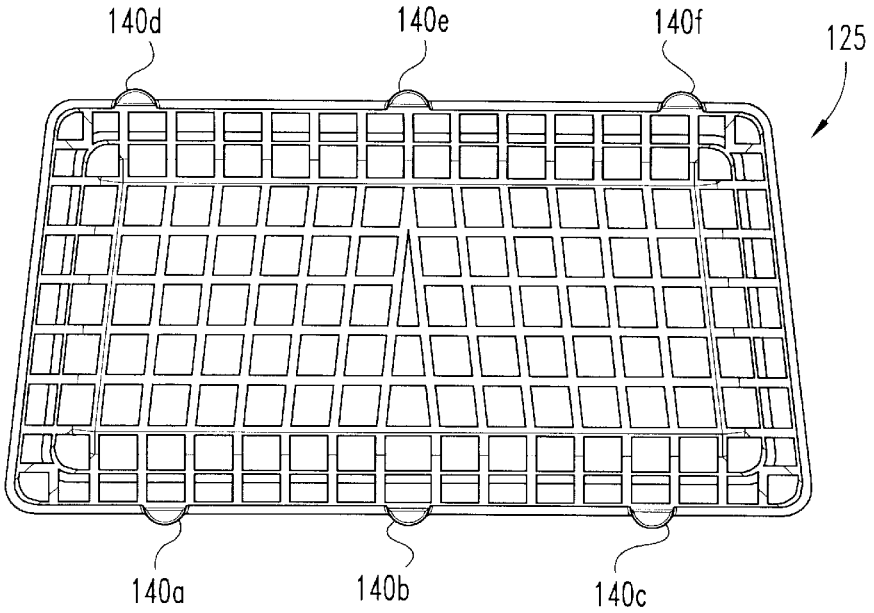
FIG. 26 is a bottom plan view of the basket guard which comprises one portion of the FIG. 18 hooded exhaust vent.
Figure 27:
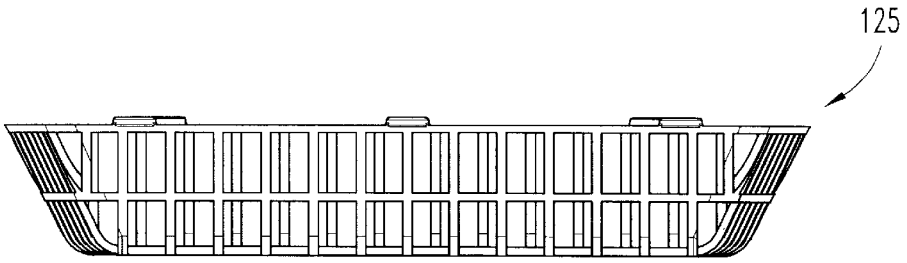
FIG. 27 is a front elevational view of the FIG. 26 basket guard.
Figure 28:
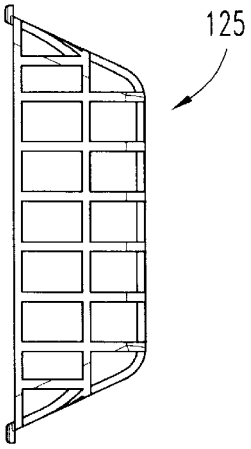
FIG. 28 is a side elevational view of the FIG. 26 basket guard.

The construction and structural details of hood 122 are further illustrated in FIGS. 21–23. The construction and structural details of basket guard 125 are further illustrated in FIGS. 26–28. With regard to FIGS. 24 and 25, the details of one representative louver 126 are illustrated in greater detail. As illustrated, louver 126 has an arcuate main body 147 extending from hinge portion 136 to lower edge 148. The sides 149 and 150 are solid panels, each with a substantially straight rear edge 151 and 152, respectively. While the two sides provided added strength and rigidity to the main body, two additional strengthening ribs 153 and 154 are molded into the back side surface 155 of main body 147. The slight concave curvature to surface 155 assists the louver in catching the exhaust air and facilitating the pivoting action of the louver. The convex outer surface 156 of main body 147 assists in deflecting any backflow of air or cross winds that might tend to cause the louver to pivot open.

In accordance with the present invention, it is envisioned that guard 23, guard 84, or guard 89 could be modified so as to have a size and shape compatible with the exit opening 124 and with hood 122 and as such, be a replacement for basket guard 125. As would be understood, guard 23 would be reshaped to a more rectangular form and two more snap-in tabs would be added, consistent with the location and spacing of tabs 140*a*–140*f*.

For the reconfiguring of guard 84, its size and shape would be modified so as to be compatible with exit opening 124 and to be compatible with hood 122. Since clips 85 and 86 attach to the sides of the hood, additional clips are not envisioned. In a similar fashion, guard 89 can be reconfigured to be compatible with exit opening 124 and with hood 122. Of course the hood 122 would need to be designed with a ledge 94 but otherwise the reconfigured guard 89 for hood 122 would still include the three clips 90, 91, and 92.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An exhaust vent for routing exhaust from a first location within a structure to a second location outside of the structure, said exhaust vent comprising:

a unitary vent hood including a rear wall defining therein an exhaust aperture, a connecting portion positioned around said exhaust aperture for the assembly thereto of an exhaust conduit, a forward wall which in cooperation with said rear wall defines an exit opening;

flow control means disposed over said exhaust aperture and being constructed and arranged for permitting flow therethrough in substantially only an exiting direction; and a unitary guard for covering over said exit opening, said guard including a plurality of projections for the snap-fit assembly of said guard to said vent hood.

2. The exhaust vent of claim 1 wherein said forward wall and said rear wall each define at least one receiving aperture and wherein each of said plurality of projections is a tab which is constructed and arranged to snap into a corresponding one of said receiving apertures.

3. The exhaust vent of claim 2 wherein said unitary guard is a substantially planar member having a front edge and a rear edge and being constructed and arranged as a grid with a plurality of grid openings.

4. The exhaust vent of claim 3 wherein there are a total of four tabs, two of said tabs being integral with said front edge and two of said tabs being integral with said rear edge.

5. The exhaust vent of claim 1 wherein said unitary guard is a substantially planar member having a front edge and a rear edge and being constructed and arranged as a grid with a plurality of grid openings.

6. The exhaust vent of claim 1 wherein each of said plurality of projections is a spring clip which is constructed and arranged to snap onto said vent hood.

7. The exhaust vent of claim 6 wherein said guard is a substantially planar member which is constructed and arranged with a grid design defining a plurality of grid openings, said guard having a pair of oppositely disposed side edges.

8. The exhaust vent of claim 7 wherein there are a total of two spring clips, one being integral with one side edge and the other being integral with the opposite side edge of said guard.

9. The exhaust vent of claim 1 wherein said guard is constructed and arranged with a basket-like shape so as to define an enlarged volume between said exit opening and said guard.

10. The exhaust vent of claim 9 wherein said forward wall and said rear wall each define at least one receiving aperture and wherein each of said plurality of projections is a tab which is constructed and arranged to snap into a corresponding one of said receiving apertures.

11. The exhaust vent of claim 10 wherein said flow control means includes a hinged flapper retained by said vent hood and extending across said exhaust aperture.

12. The exhaust vent of claim 10 wherein said flow control means includes a pair of hinged louvers which have an overlapping relationship, said louvers being received by said vent hood and extending across said exhaust aperture.

13. A vent guard for covering over the exit opening of a hooded exhaust vent, the hooded exhaust vent including a hood and flow control means, said vent guard comprising:

a substantially planar grid portion defining a plurality of grid apertures;

a surrounding outer edge which is integral with said grid portion; and a plurality of attachment projections extending from said outer edge and being integral therewith, each of said plurality of attachment projections being constructed and arranged for attachment to said hood and for being positioned over said exit opening.

14. The vent guard of claim 13 wherein each of said plurality of attachment projections is a snap-in tab.

15. The vent guard of claim 13 wherein each of said plurality of attachment projections is a spring clip.

16. The vent guard of claim 13 wherein each of said plurality of attachment projections is a slide-on clip.

17. A basket guard for covering over the exit opening of a hooded exhaust vent, the hooded exhaust vent including a hood and flow control means, said basket guard comprising:

a basket-shaped grid portion defining a plurality of grid apertures;

a surrounding outer edge which is integral with said grid portion; and a plurality of attachment projections extending from said outer edge and being integral therewith, each of said plurality of attachment projections being constructed and arranged for attachment to said hood and for being positioned over said exit opening.

18. The basket guard of claim 17 wherein each of said plurality of attachment projections is a snap-in tab.

* * * * *

UNITED STATES PATENT AND TRADEMARK OFFICE

CERTIFICATE OF CORRECTION

PATENT NO : 5,916,023

DATED : June 29, 1999

INVENTOR(S) : Stephen T. Meyer

It is certified that error appears in the above-identified patent and that said Letters Patent is hereby corrected as shown below:

Col. 1, at line 40, delete the ")" after "into".

Col. 2, at line 14, replace "aid" with -- and--.

Col. 2,at line 33, replace "assemble" with -- assembly--.

Col. 6, at line 27, replace "sidewalks" with -- sidewalls--.

Col. 7, at line 32, replace "Basset" with -- Basket--.

Signed and Sealed this

Twenty-sixth Day of September, 2000

*Attest:*

*Attesting Officer*

Q. TODD DICKINSON

*Director of Patents and Trademarks*